United States Patent [19]

Eirich et al.

[11] Patent Number: 5,018,673

[45] Date of Patent: May 28, 1991

[54] CONTINUOUSLY WORKING MIXER

[75] Inventors: Paul Eirich, Hardheim; Werner Christen, Mannheim, both of Fed. Rep. of Germany

[73] Assignee: Draiswerke GmbH, Mannheim, Fed. Rep. of Germany

[21] Appl. No.: 438,271

[22] Filed: Nov. 20, 1989

[30] Foreign Application Priority Data

Nov. 24, 1988 [DE] Fed. Rep. of Germany ..... 3839671

[51] Int. Cl.[5] ..... B02C 18/14

[52] U.S. Cl. ..... 241/62; 241/101 B; 241/279; 366/173

[58] Field of Search ..... 366/102, 169, 172, 173, 366/293, 279; 241/65, 101 B, 281.2, 280, 281.3, 38, 62

[56] References Cited

U.S. PATENT DOCUMENTS

| | | | |
|---|---|---|---|
| 3,134,576 | 5/1964 | Lodige et al. . | |
| 3,162,428 | 12/1964 | Lodige et al. . | |
| 3,522,934 | 8/1970 | Walter . | |
| 3,734,471 | 5/1973 | Engels | 366/173 |
| 4,006,887 | 2/1977 | Engels . | |
| 4,705,222 | 11/1987 | Shohet | 241/101 B X |

FOREIGN PATENT DOCUMENTS

| | | | |
|---|---|---|---|
| 1102534 | 3/1961 | Fed. Rep. of Germany . | |
| 1297325 | 6/1969 | Fed. Rep. of Germany . | |
| 2057594 | 6/1972 | Fed. Rep. of Germany . | |
| 2240454 | 3/1974 | Fed. Rep. of Germany | 241/282.1 |
| 3105549 | 9/1982 | Fed. Rep. of Germany . | |
| 3406648 | 8/1987 | Fed. Rep. of Germany . | |
| 2625923 | 10/1987 | Fed. Rep. of Germany . | |
| 1307173 | 2/1973 | United Kingdom . | |

OTHER PUBLICATIONS

Maloney, Thomas M., Modern Particleboard & Dry--Process Fiberboard Manufacturing, copyright 1977, Library of Congress Catalog Card No., 76-47094, International Standard Book No. 0-87930-063-9, USA.

*Primary Examiner*—Mark Rosenbaum

*Attorney, Agent, or Firm*—Browdy and Neimark

[57] ABSTRACT

In an annular mixer for the wetting of solid matter, in particular for the wetting of fibrous material with a binding agent, a plurality of cutting devices are provided, downstream of a wetting zone and a subsequent secondary mixing zone and upstream of an outlet, in a radial plane relative to the shaft, for the reliable separation of clusters.

7 Claims, 3 Drawing Sheets

FIG. 4
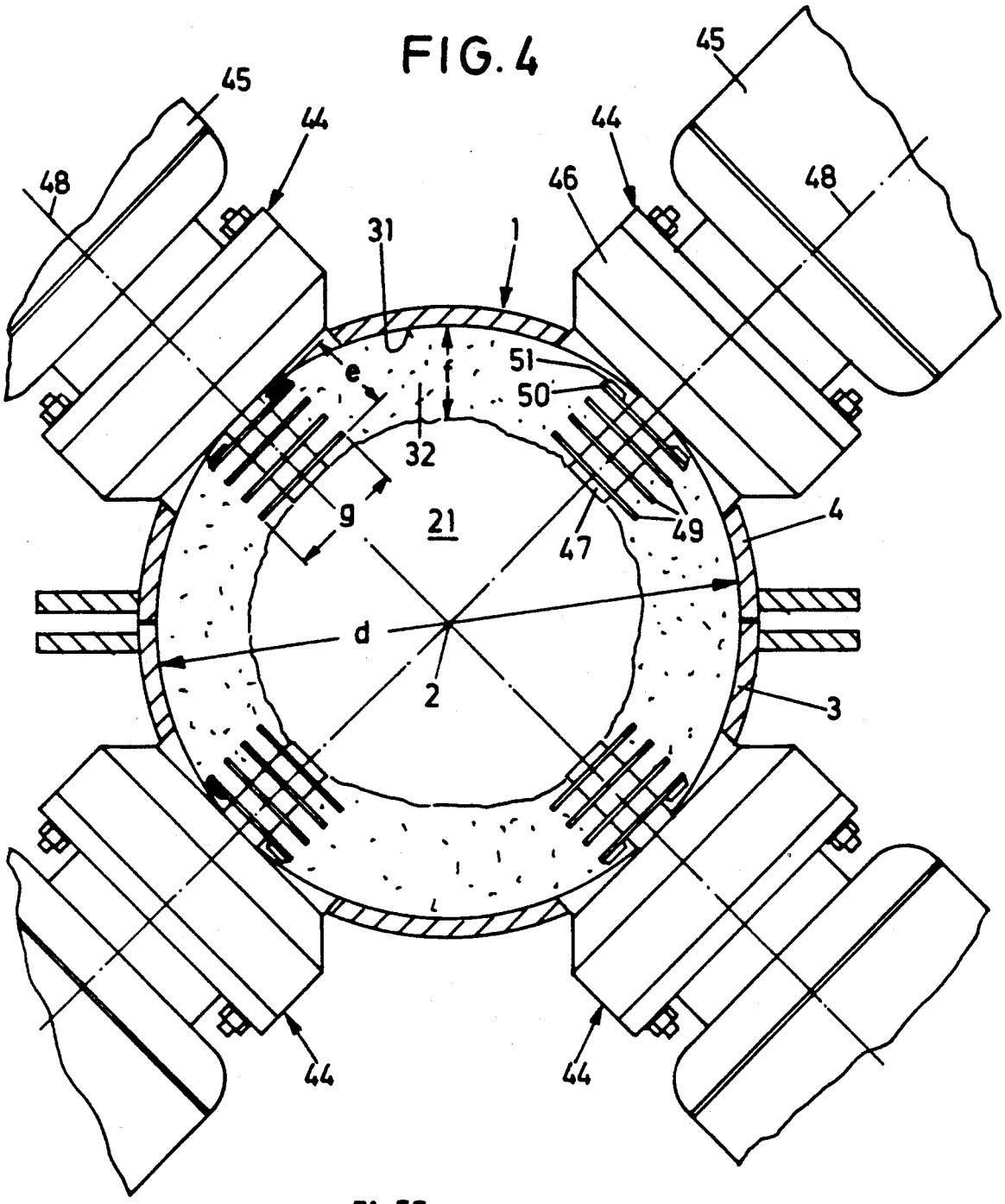
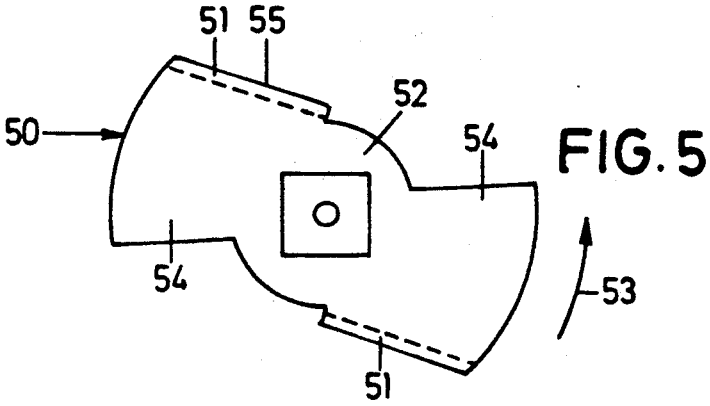
FIG. 5

CONTINUOUSLY WORKING MIXER

FIELD OF THE INVENTION

The invention relates to a continuously working mixer for the wetting of, in particular, fibrous material with a liquid, in particular a binding agent, in a ring of material, comprising an essentially horizontally arranged cylindrical housing in which a mixing apparatus which can be driven at high speed is arranged coaxially, which mixing apparatus comprises mixing tools which project essentially radially therefrom and into the vicinity of the inner wall of the housing, wherein the housing is provided at one end with a material supply pipe for the continuous supply of material and, at the other end, with a material discharge pipe for the continuous removal of wetted material, and wherein a wetting zone is provided downstream, in the axial conveying direction, of a draw-in zone which is associated with the material supply pipe, in which wetting zone means are provided for the admission of liquid into a ring of material, in which the material is helically conveyed and moved on the inner wall of the housing through its interior, and wherein means are provided for the separation of clusters.

BACKGROUND OF THE INVENTION

Mixers of the generic kind, which are also referred to as annular-layer mixers, are widely known, for example from U.S. Pat. No. 3,734,471. Special measures, in the form of mixing tools which acutely taper in the direction of the container wall, have been taken in the case of such annular-layer mixers, in particular for the application of glue to wood fibres, in order to separate the fibres which, after the application of glue, tend to form clusters, as is known from U.S. Pat. No. 4,006,887. These measures have, however, not had the desired effect, i.e. to separate the clusters.

In order to assist the separation of clusters, the residence time of the wetted materials in the mixer was extended by providing, at the outlet, adjustable or controlled adjustable outlet valves, as a result of which an adjustable or controllable backpressure was exerted on the material, in order thus to subject it for a longer period of time to the separating action of the specific tools. This resulted in considerable caking of the material in the outlet region, which was also not desirable.

SUMMARY OF THE INVENTION

It is an object of the invention to develop a mixer of the generic kind such that clusters are specifically and reliably separated, while at the same time a high rate of throughput and a high degree of uniformity of wetting is to be achieved.

According to the invention this object is met in that, in the conveying direction, immediately upstream of the material outlet pipe, a plurality of cutting devices are provided in a radial plane relative to the shaft. As a result of the measures according to the invention, it is ensured that the wetted material, which has formed considerable clusters, is guided, immediately prior to reaching the outlet, through the cutting devices, it being ensured that each cluster comes into contact, at least once but preferably repeatedly, with a cutter and is separated. The wetted, non-clustered particles of material which leave the region of the cutting devices are directed immediately to the outlet and cannot again form clusters. The number of cutting devices depends on the size of the mixer and the relationship between the circumferential speed of the mixing tools and the axial flow rate of the material. This relationship must be selected such that all the particles of material are definitely seized by the cutting devices when passing the latter. When a greater number of cutting devices are arranged to be distributed on the circumference of the housing of the mixer, the operation takes place at a considerably greater axial transfer rate of the material. In this way, it is possible to achieve a higher rate of throughput with a mixer of predetermined size at the same intensity of mixing. It has been found that the formation of clusters, in the case of fibrous material to be wetted with binding agent, takes place as a result of the rolling-down movement of the material at the inner wall of the housing. When it is not a case, as described above, of fibrous material, such as paper fibres or even wood fibres, that are to be wetted and, in particular, to which glue is to be applied, but when powder, such as for example lime, is wetted, then clusters, i.e. lumps having a diameter of several millimeters, can be broken to pieces; on the other hand, granules having a diameter of, for example, less than 1 mm, and which were specifically produced during the wetting process, can be maintained.

Further features, advantages and details of the invention are set out in the ensuing description of an exemplary embodiment, taken in conjunction with the drawing.

BRIEF DESCRIPTION OF THE DRAWING

FIG. 4 shows a cross-section of the housing in the region of the cutting devices without illustrating the mixing apparatus, and FIG. 5 shows a plan view of a cutter of a cutting device of the mixer.

DESCRIPTION OF THE PREFERRED EMBODIMENT

Figure 1:
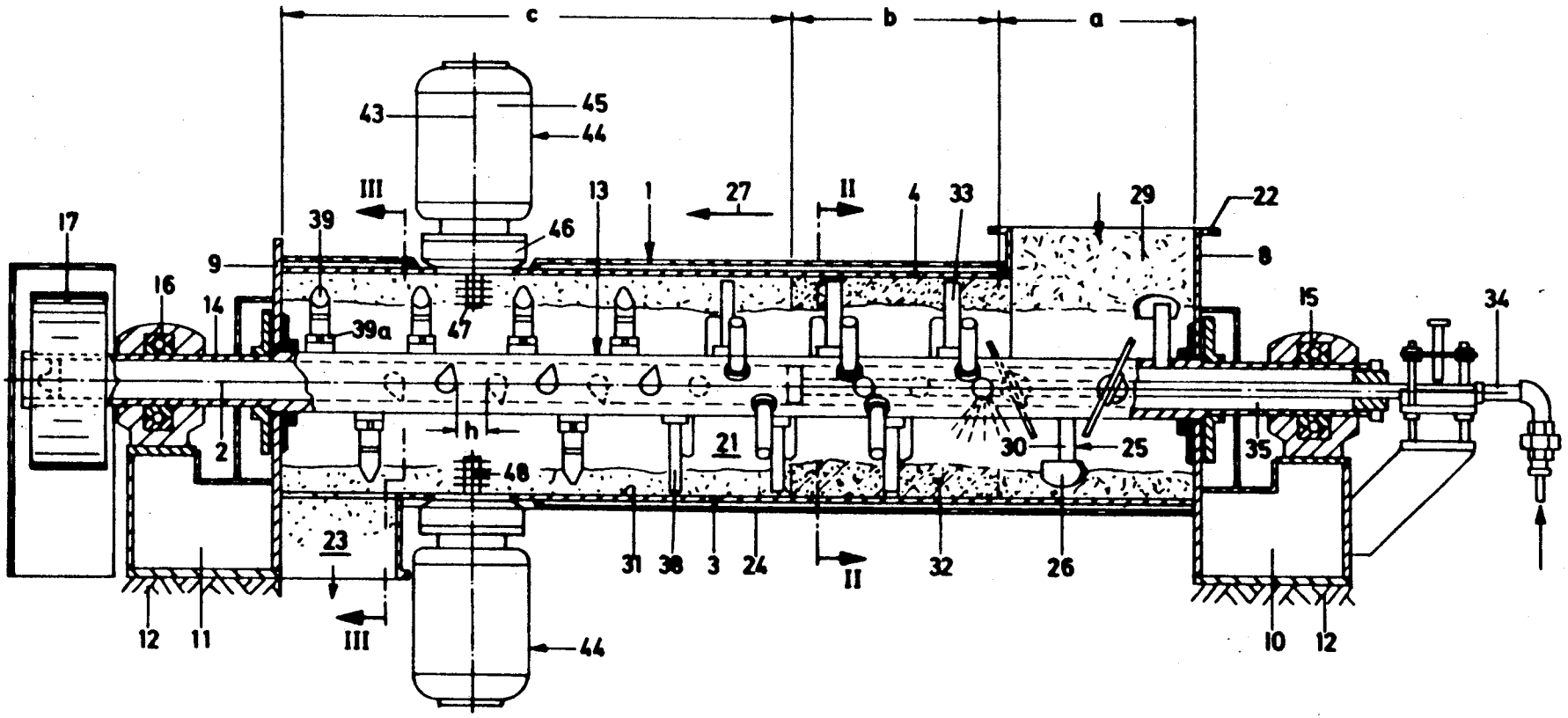
FIG. 1 shows a mixer according to the invention in a vertical longitudinal section.

The mixer illustrated in the drawing comprises an essentially cylindrical housing 1 which is separated in a horizontal plane which is disposed in a horizontal central longitudinal axis 2 of the housing. It therefore comprises a semi-cylindrical housing bottom part 3 and a, likewise semi-cylindrical, housing upper part 4 which parts are interconnected, on one side, by means of pivot hinges 5, and which are interconnectable on the opposite side by means of readily releasable bent-lever closures 6, with the result that, after releasing these closures 6, the housing upper part 4, which is counterbalanced with a counterweight 7, can readily be pivoted up and away from the bottom part 3.

The housing 1 is sealed at its transverse ends by end walls 8, 9 which also support the bottom part 3 and which terminate in machine bearings 10, 11. These machine bearings 10, 11 are supported on a foundation 12.

Arranged concentrically with the central longitudinal axis 2 in the housing 1, is a mixing apparatus 13, the shaft 14 of which projects through both ends of the housing 1 and is sealed by the end walls 8, 9. The shaft 14 is supported in shaft bearings 15, 16 which are also supported on the machine bearings 10, 11. Rotationally fixed to one end of the shaft 14, is a belt pulley 17, across which is passed a driving belt 18 which, in turn, is directed via a belt-driving pinion 19 of a drive motor 20, which is also supported on and attached to the foundation 12.

Figure 2:
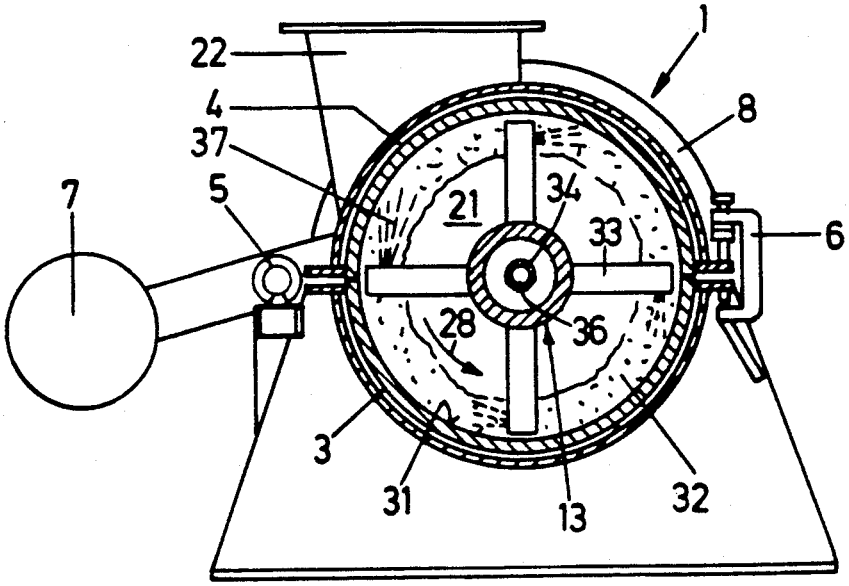
FIG. 2 shows a cross-section of the mixer along the intersecting line II—II of FIG. 1.
Figure 3:
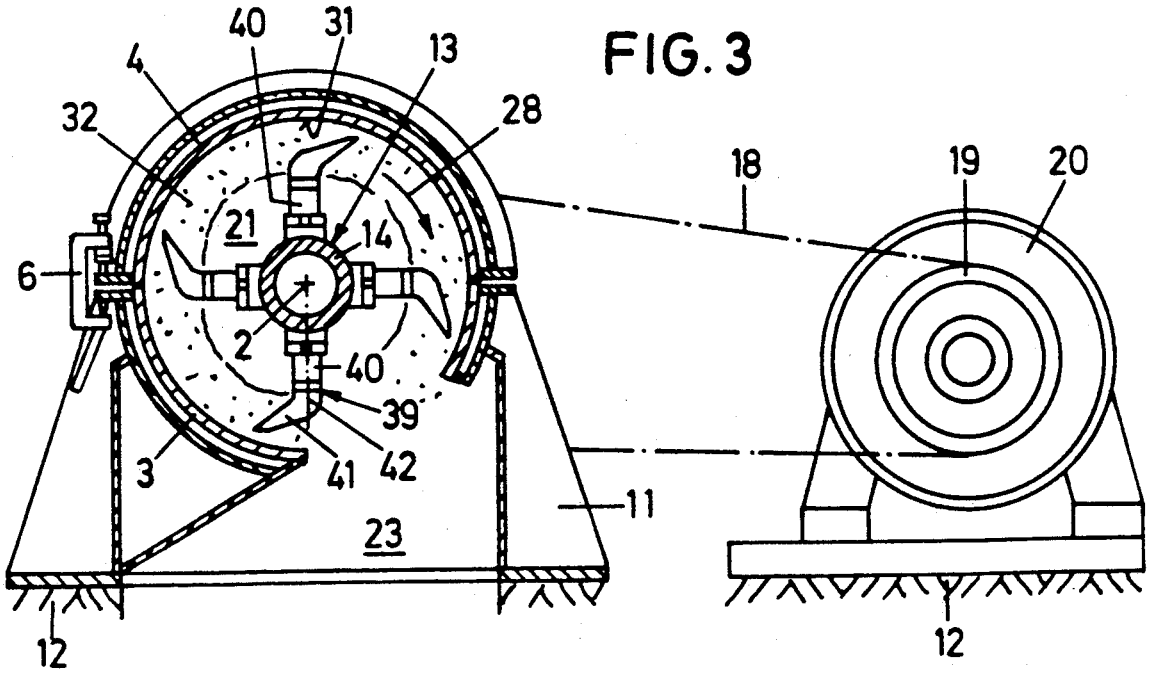
FIG. 3 shows a cross-section of the mixer along the intersecting line III—III of FIG. 1.

At one end of the housing 1, in FIG. 1 on the right-hand, a material supply pipe 22, which is attached to the upper part 4 and which, as can be seen in FIG. 2, opens up substantially tangentially into the interior 21 of said housing. At the opposite end, i.e. on the left-hand side in FIG. 1, of the housing 1, a material discharge pipe 23, which is also arranged substantially tangentially relative to the interior, as can be seen in FIG. 3, opens up out of the interior 21 of said housing. As can be seen in the drawing, the housing 1 is designed to be double-walled, i.e. it comprises a tempering jacket 24, through which a tempering medium, in particular, therefore, cooling water, but also a heating medium, can be passed.

Provided on the shaft 14 of the mixing apparatus are numerous mixing tools of varying construction. In the region of the material supply pipe 22, a draw-in zone a is provided, in which draw-in or accelerating tools 25 are attached to the shaft 14. They comprise, essentially, relatively large paddles 26 which are set in the axial conveying direction 27 and in the direction of rotation 28 of the mixing apparatus 13, so that the pourable material 29, which is admitted through the supply pipe 22, is accelerated in the direction of rotation 28 and is set in motion in the axial conveying direction 27 by said paddles. The paddles 26 are attached to the shaft 14 by means of arms 30. As can be seen in FIG. 1, the paddles 26 completely overlap one another in the axial direction; in addition, they extend close to the inner wall 31 of the housing 1, so that no dead spaces are provided in which the material 29 could be deposited. The mixing apparatus 13 is driven at 20 to 40 times the critical speed, with the result that the material 29, at a point already immediately behind the supply pipe 22, is placed, in the form of a material ring 32, against the inner wall 31 of the housing 1, in which form it is conveyed helically through the interior 21 of the housing 1. The term "critical speed" is understood to mean the number of revolutions of the mixing apparatus 13 at which acceleration due to gravity occurs at the radially outer ends of the tools.

Following on the draw-in zone a, in the conveying direction 27, is a wetting zone b. In this wetting zone b, liquid-adding and mixing tools 33 are attached to the shaft 14. These tools 33 can be designed to be approximately cylindrical mixing arms which extend closely up to the inner wall 31 and which, as can also be seen in FIG. 1, also overlap one another in the axial direction, so that no dead spaces, in which material 29 is not intensively wetted, occur in the wetting zone b either. The liquid-adding and mixing tools 33 are connected to a liquid supply pipe 34, which is guided concentrically with the axis 2 through a shaft hollow space 35 of the shaft 14 which is constructed to be hollow. This liquid supply pipe 34 has, in the region of the wetting zone b, liquid discharge openings 36. Liquid, which is supplied via the supply pipe 34 by a pump which is not illustrated, enters the shaft hollow space 35 through said discharge openings 36. Owing to the high speed and the resultant centrifugal forces, this liquid is flung into the individual tools 33, flows through the latter and is discharged by them, in the form of finely dispersed liquid 37, at their radially outer end into the ring 32 of material which is maintained by the tools 33, even in the wetting zone b. The rotational speed of the ring 32 of material in the direction of rotation 28 is approximately half of that of the rotational speed of the tools 33 in the radially outer region. In respect of the liquid supply system, the design of the liquid-adding and mixing tools 33 can also be such as is illustrated and described in U.S. Pat. No. 4,006,887.

Connected downstream of the wetting zone b and extending to the discharge pipe 23, i.e. substantially to the axial end of the interior 21, is a secondary mixing zone c. In this secondary mixing zone c, are arranged mixing tools 38 which may, in their outer construction, be similar to the tools 33, but which no longer serve the purpose of supplying liquid. On the other hand, approximately hook-shaped mixing tools 39 can also be provided which comprise a cylindrical, tubular, radially-extending part 40 and a tapering hook member 41 which leads in the direction of rotation 28, which is folded forward relative to the part 40 and which reaches close to the inner wall 31. These tools 39 can, for example, be designed in detail such as is illustrated and described in U.S. Pat. No. 4,183,670. These tools are screw-connected to the shaft 14 by means of a union nut **39*a*, in such a way that they can be rotated about their radial longitudinal axis 42, i.e. the hook member 41 can be set against the axial conveying direction 27 or in this conveying direction 27, so that an impulse which either delays or accelerates the axial movement can be exerted on the material 29. Whereas the plain bar- or rod-shaped tools 33 and 38, respectively, exert impulses on the material 29 only in the direction of rotation 28, the axial passage can, in this way, also again be delayed or accelerated by the tools 39. At the end of the secondary mixing zone c, the material is discharged through the material outlet pipe 23. The hook-shaped mixing tools 39 can also be replaced by other mixing tools namely, in particular, such tools as will exert an increased axial impulse or a braking effect on the material 29** by changing the setting angle. Mixing tools of this kind are known, for example, from U.S. Pat. No. 3,734,471.

Immediately upstream of the outlet pipe 23, a plurality of cutting devices 44, in the present case four, are arranged in a common radial plane 43 relative to the central longitudinal axis 2. As can be seen in FIG. 4, they are arranged, in each case, with equal angular spacing, for example therefore 90 , and, because of the separation of the housing 1 in a horizontal plane, are staggered relative to this plane. Each cutting device 44 comprises an electromotor 45 which is screw-connected to a holding means 46 which is attached to the housing 1 and projects through the latter. A cutter shaft 47, which is driven by the electromotor 45 and which is directed radially into the interior 21, projects through the holding means 46. The axes 48 of the cutter shafts 47 are therefore disposed in the radial plane 43 and intersect the axis 2. A plurality of cutters 49, 50 are provided, axially spaced relative to the axes 48, on each cutter shaft 47. The cutters 49 are identical to one another; it is merely the cutters 50, which are immediately adjacent to the inner wall 31, which have stripping devices 51 which are bent over towards the inner wall 31, by means of which stripping devices material 29 which may have been deposited between this cutter 50 and the inner wall 31 is flung back into the ring 32 of material. The axial extension e of cutters 49, 50 substantially corresponds to the thickness f of the ring 32 of material.

The diameter g of the cutters 49 and 50 is only slightly smaller than the spacing h between the mixing tools 39 which are axially adjacent in this region. By means of the appropriate setting of the mixing tools 39, which are arranged immediately downstream, in the conveying direction 27, of the cutting devices 44, in a direction opposite to the conveying direction 27, it can be achieved that the material 29, which is conveyed as a ring 32 of material, remains in the region of the cutting devices 44 for a longer period of time, i.e. in that an impulse which acts counter to the conveying direction 27 is exerted on the material 29. As a result of the measures described, it is achieved that all not very small particles of material pass the cutters 49 or 50 automatically at least once. The cutter shafts are driven at a speed such that the circumferential speed at the outside diameter of the cutters 49 and 50 is approximately 10 to 40 m/s. The diameter g of the cutters 49, 50 is about 50 to 250 mm, this depending on the size of the mixer, i.e. depending on the diameter d of the interior 21 of the housing 1. The mixing tools 25 and 39 are designed and set relative to the axial conveying direction 27 such that, taking into consideration the speed of the mixing apparatus 13, an axial feed rate of the material in the mixer of between 0.02 m/s and 0.2 m/s is achieved. In the case of a mixer having a diameter d of, for example, 500 mm, the operation takes place at a thickness f of the ring 32 of material of 30 to 120 mm. The axial extension e of the cutters 49, 50 in the direction of the axes 48 should, in this regard, be between 40 and 130 mm, so that, with a degree of certainty, no particles of material are present in the radially inner region of the ring 32 of material which are not seized by at least one cutter 49 or 50. For the relationship between the thickness f of the ring 32 of material and the diameter d of the housing 1, $0.06 \leqq f/d \leqq 0.24$ applies.

The shape of the cutters can be seen in FIG. 5, wherein only that cutter 50 which is adjacent to the inner wall 31 has been illustrated. Starting from the hub 52, said cutter has two cutting edges 54 which lead in the direction of rotation 53 of the cutting devices 44. In the case of the cutters 50, the stripping device 51 is, in each case, formed in the region of the edge 55 which trails in the direction of rotation 53, i.e. the rear edge, by bending over the flat cutter. The cutters 49 are, in principle, identical, with the exception that they have no stripping device.

Materials 29 having a high tendency to form clusters, such as, for example, paper fibres and wood fibres, are preferably wetted in the mixer. These clusters, which form in the wetting zone b after the addition of the binding agent, are completely separated by the cutting devices 44. For example, paper fibres which are subsequently used in the manufacture of gypsum-plasterboards, can be wetted with glue. On the other hand, it is also possible to wet a premixed batch of gypsum and paper fibres with a mixture of binding agent and water, so that a gypsum/paper fibre/binding agent/water mixture, which is free of lumps and clusters, is discharged through the outlet pipe 23 and can be subjected directly to further processing to form gypsum-plaster boards. In the same manner, other materials which form clusters after wetting can also be wetted with a liquid for the purposes of a so-called material-ring mixing.

In like manner, on the other hand, it is also possible to granulate powder with liquid to form granules having a grain size of less than 1 mm, whereby, in this case, clusters having a considerably larger diameter of, for example, 3 to 6 mm, are completely shattered in the cutting devices 44, without thereby destroying the far finer granules. When wetting such powdery substances with liquid, for example gypsum with water, the operation takes place with a far thinner ring 32 of material than was previously specified. In contrast, when wetting fibrous materials, the operation is carried out with a greater thickness f of the ring 32 of material.

We claim:

1. Continuously working mixer for the wetting of, fibrous material with a liquid binding agent, in a ring of material, comprising:

an essentially horizontally arranged cylindrical housing (1), which is provided at a first end with a material supply pipe (22) for a continuous supply of material (29) and, at a second end, with a material discharge pipe (23) for a continuous removal of wetted material and which has an inner wall (31);

a mixing apparatus (13) which is arranged coaxially in the housing and which is driveable at high speed and which mixing apparatus comprises mixing tools (25, 33, 38, 39) which project essentially radially therefrom and into the vicinity of the inner wall (31) of the housing (1);

a draw-in zone (a) which is associated with a material supply pipe (22);

a wetting zone (b) which is provided downstream in an axial conveying direction (27) of the draw-in zone (a);

means for the admission of liquid into a ring (32) of material (29) which are provided in the wetting zone (b), and which ring (32) of the material (29) is helically conveyed and moved on the inner wall (31) of the housing (1) through its interior (21); and means for the separation of clusters, wherein, the conveying direction (27), immediately upstream of the material discharge pipe (23), a plurality of cutting devices (44) are provided in a radial plane (43) relative to the shaft (14) said cutting devices (44) being arranged at equal angular spacings relative to one another around the full circumference of said housing (1), wherein said cutting devices (44) each comprise one cutter shaft (47) with an extension (e) projecting from the inner wall (31) of the housing (1) into the interior (21) and which is provided with a plurality of spacingly arranged cutters (49, 50), wherein said extension (e) of said cutter shaft in the direction of its axis (48) substantially corresponds to the thickness (f) of the ring (32) of material.

2. Mixer according to claim 1, wherein the diameter (g) of the cutters substantially corresponding to the spacing (h) between adjacent mixing tools (39).

3. Mixer according to claim 1, wherein the cutters being rotatable at a circumferential speed of 10 to 40 m/s.

4. Mixer according to claim 1, wherein, in the conveying direction (27) downstream of the cutting devices (44), at least one mixing tool (39) is provided which, for the purpose of producing a backpressure on the material, can be adjusted in a direction opposite to the conveying direction (27).

5. Mixer according to claim 1, wherein with regard to a diameter (d) of the housing (1) and the thickness (f) of the ring (32) of material the following ratio applies:

$$0.06 \leqq f/d \leqq 0.24$$

6. Mixer according to claim 1, wherein four cutting devices (44) are arranged at angular spacings of 90° relative to one another.

7. Mixer according to claim 1, wherein the housing (1) is separated in a horizontal plane, and wherein the cutting devices (44) are staggered relative to this horizontal plane.

* * * * *